US006462717B1

(12) United States Patent
Wheelock et al.

(10) Patent No.: US 6,462,717 B1
(45) Date of Patent: Oct. 8, 2002

(54) ENCLOSURE FOR MICROWAVE RADIO TRANSCEIVER WITH INTEGRAL REFRACTIVE ANTENNA

(75) Inventors: Glenn E. Wheelock, Fremont; Josef Berger, Santa Clara; Russell K. Layton, Jr., Mt. View, all of CA (US)

(73) Assignee: Caly Corporation, Sunnyvale, CA (US)

( * ) Notice: Subject to any disclaimer, the term of this patent is extended or adjusted under 35 U.S.C. 154(b) by 0 days.

(21) Appl. No.: 09/927,300

(22) Filed: Aug. 10, 2001

(51) Int. Cl.[7] ..... H01Q 1/42

(52) U.S. Cl. ..... 343/872; 343/874; 343/876; 343/911 L

(58) Field of Search ..... 343/753, 754, 343/872, 874, 876, 909, 911 R, 911 L

(56) References Cited

U.S. PATENT DOCUMENTS 4,397,035 A 8/1983 Nothnagel et al. ..... 455/90
6,329,956 B1 * 12/2001 Tateishi et al. ..... 343/753
6,356,247 B1 * 3/2002 Hirtzlin et al. ..... 343/753
6,380,904 B1 * 4/2002 Ogawa ..... 343/754

FOREIGN PATENT DOCUMENTS

WO WO00/25485 5/2000
WO WO00/76088 12/2000

* cited by examiner

*Primary Examiner*—Don Wong
*Assistant Examiner*—Shih-Chao Chen
(74) *Attorney, Agent, or Firm*—Thomas Schneck

(57) ABSTRACT

An all-weather housing for outdoor microwave radio nodes arranged in a network, each node capable of directing or receiving a beam of microwave energy in a selected direction, the housing including a shroud enclosing a transceiver, antenna, switches, and utilities. Each shroud has a radome projecting from the shroud in line of sight relation to other radomes in the network. A microwave radio transceiver is disposed within the shroud, operating on a scheduled transmission and reception basis in accordance with a schedule provided in a control channel amidst data. A ball-shaped microwave refractive lens is located adjacent to the radome, inside of the shroud, with a curved array of feed ports and switches, with the feed ports communicating microwave energy between the transceiver and the radome through the lens in multiple selected directions.

35 Claims, 6 Drawing Sheets

ENCLOSURE FOR MICROWAVE RADIO TRANSCEIVER WITH INTEGRAL REFRACTIVE ANTENNA

FIELD OF THE INVENTION

This invention relates to environmental housings for electrical equipment and, more particularly, to an outdoor mounted all-weather enclosure for microwave radio transceivers.

BACKGROUND ART

PCT application WO 00/25485, published May 4, 2000, discloses a broadband wireless network invention by Berger et al. based on mesh topology having a plurality of wireless transceivers operating in the gigahertz range with the ability of adding and dropping data at each transceiver, as well as routing data between multiple wireless transceivers. Transceivers with switches are considered to be nodes, designed to select a transmission direction and a receive direction based upon the routing address of data packets to be sent and received. The selection of a transmission or receive direction is done instantaneously to accommodate short bursts of data packets arriving from nodes located at different directions or transmitted towards nodes located at different directions as defined by a scheduler of the MAC (media access control) layer.

PCT application WO 00/76088, published Dec. 14, 2000, discloses a scheduler and control algorithm for a system as described above. The scheduler is designed to efficiently allow implementation of mesh networks with IP packet data flow between the network nodes or backbone access points. The disclosed MAC protocol features transmission of synchronous schedule information in a control channel between the nodes to assign asynchronous variable length packet data slots in between the schedule information time slots. Available data slots are adaptively assigned by each recipient node to the data initiator node based on requested time slots by the initiator and the available time slots of the recipient.

The mesh topology networks described above operate in the multi gigahertz spectrum, i.e. microwave bands. In 1998, the FCC auctioned a large amount of the radio spectrum in the 27 GHz and 31 GHz bands for use in Local Multipoint Distribution Systems. Similar spectral bands were opened for use in Canada, Australia, New Zealand and Argentina. In Europe, the radio spectrum between 24.5 GHz and 26.5 GHz was also assigned for multipoint use. Many countries are in the process of opening different bands at the high frequency spectrum between 10 GHz and 40 GHz for use on a territorial basis rather than on a link per link basis, as in the past. This main difference of approach in licensing the radio spectrum enables the network operator to build a network, which covers a large topographical area and offers connectivity services to those customers in line of sight relation in the area. This is because millimeter wave transmission depends on line of sight between communicating transceivers. An arrangement of devices as described above is shown in PCT international patent application PCT/US00/15482, published Dec. 14, 2000.

Another type of radio system operating in the same spectral region is the point to multipoint network. Such a system employs a simpler MAC layer because of the broadcast nature of the downstream link and the polling of the upstream link. When the base station transmits in a certain frequency and time slot, all the customers in the sector except the one that receives information are blocked from receiving any information. In the upstream direction, only one customer can transmit at a certain time on a certain frequency.

For these types of communications systems, an object of the invention was to provide a rugged, durable, mast-mounted, all-weather radio housing. Such a housing must allow multiple directional beams of millimeter waves to be transmitted to nodes dispersed over wide angles, i.e. typically wider than 90 degrees, for line of sight communication between nodes.

SUMMARY OF INVENTION

The present invention is a fixed weather-tight enclosure, acting as a housing for a wireless node, including a microwave radio transceiver in an adaptive wireless network, such as a mesh topology network, capable of sending and receiving energy in multiple directions. The enclosure features an exterior shroud, having an elliptical cross section for shedding rain and snow. The overall appearance of the unit is almost egg-shaped, with a maximum dimension of about one-half meter. The enclosure protectively shields an exposed bullet shaped radome, similar to the type used on aircraft fuselages, pointed in line of sight relation to one or more other similar enclosures. Other enclosures communicate with each other on the same basis. Each enclosure provides environmental protection for a passive curved microwave radio refractive lens acting as a non-resonant antenna capable of transmitting and receiving in selected directions. This lens receives and refractively bends electromagnetic energy from or to a curved array of feed ports, proximate to the curved surface of the lens element, so that the antenna can selectively transmit radiation in desired directions, depending upon the particular radio frequency feed ports providing energy to the refractive element. The radome provides sufficient clearance to allow passage of beams or signal lobes over various angles typically exceeding 90 degrees in spread with beam widths of a few degrees. A microwave radio transceiver, the microwave refractive lens, the array of feed ports and support circuits all fit within the enclosure.

The enclosure is mounted on a mast by a bracket attached to heat sink fins on the rearward portion of the shroud. The bracket allows angular adjustment, both horizontally and vertically, of the pointing direction of the radome.

The shroud has two major compartments. A first compartment is the body which houses the supports for the microwave lens, switches, fan and heater, and the feed element array. The second compartment surrounds the first compartment and has the power supply, transceiver, motherboard, and a second radio for local communication, control, and utility circuits. The second compartment, being made of thermally conductive metal, preferably aluminum, defines heat sink fins in the rear of the shroud body. A small door, also in the rear of the shroud body, gives access to power and data cables, as well as wires, leading into the interior of the second compartment. Access to the unit power supply is through the same small door so that disassembly of the entire unit is not needed to check or repair the power supply.

Within the first compartment, an electrical heater, a fan and a control circuit operate to circulate warm air within the radome with sufficient capacity to avoid accumulation of frost or ice on the exterior surface of the radome. An interior partition within the shroud provides support for the base of the radome. The partition has a central aperture allowing the microwave lens to extend from the rearward portion of the shroud into the radome. Also with the first compartment is a support frame having spaced apart sockets for securing the microwave lens. The lens, in the preferred version, is ball shaped and has spaced apart protuberances on opposite sides of the ball shape, which fit into the sockets in an interlocking manner.

A network of similar enclosures mounted on masts or high locations relay data among themselves according to schedules in a control channel transmitted with the data. Enclosures having several other enclosures in a line of sight relation may select the direction of transmission, depending on addresses contained within the control channel of information received. The protective shroud in each enclosure helps establish an all weather-operating environment for mast mounted microwave transceivers.

BEST MODE FOR CARRYING OUT THE INVENTION

Figure 1:
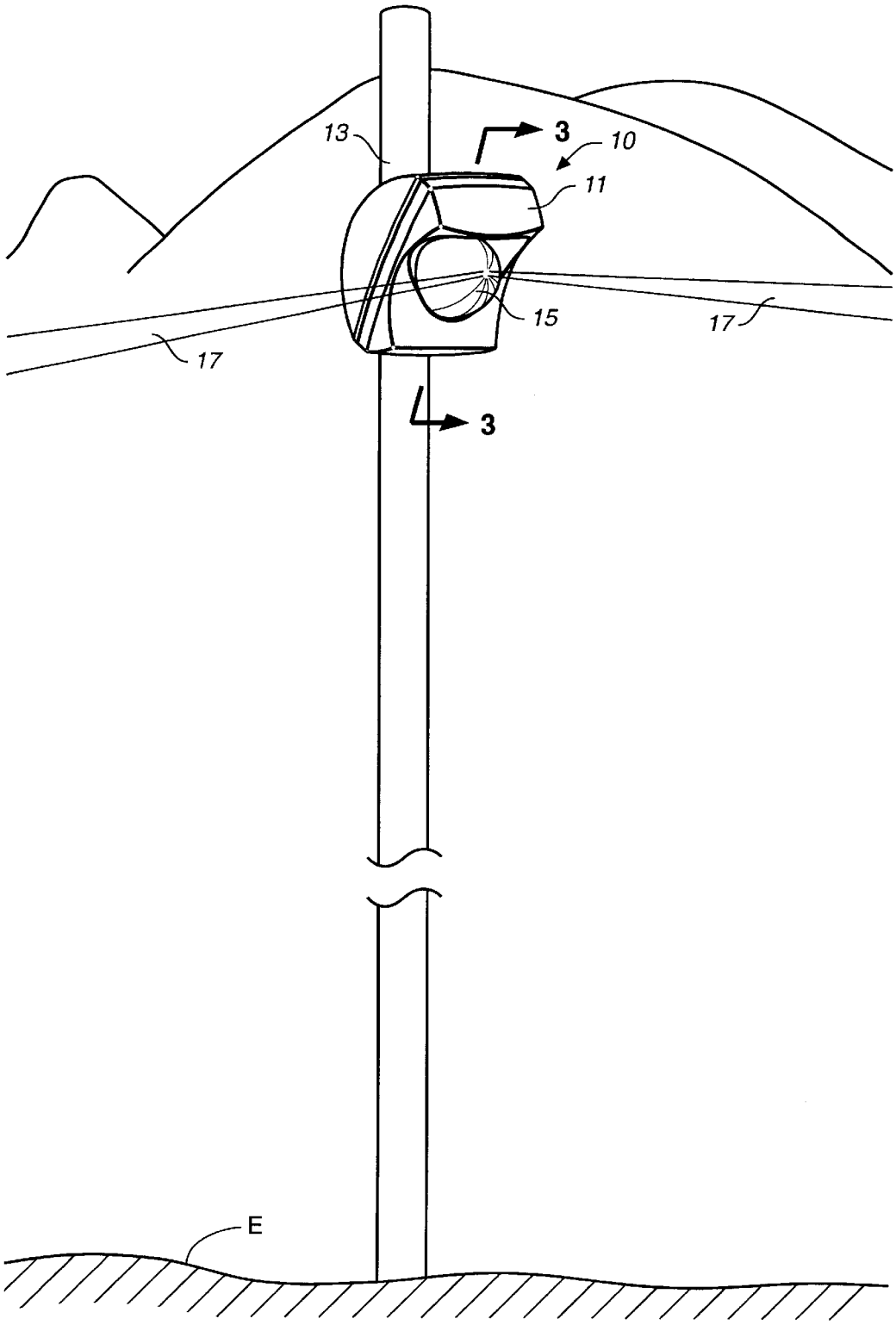
FIG. 1 is a perspective view of an all weather, mast mounted, enclosure for a microwave radio transceiver in accordance with the present invention.
Figure 2:
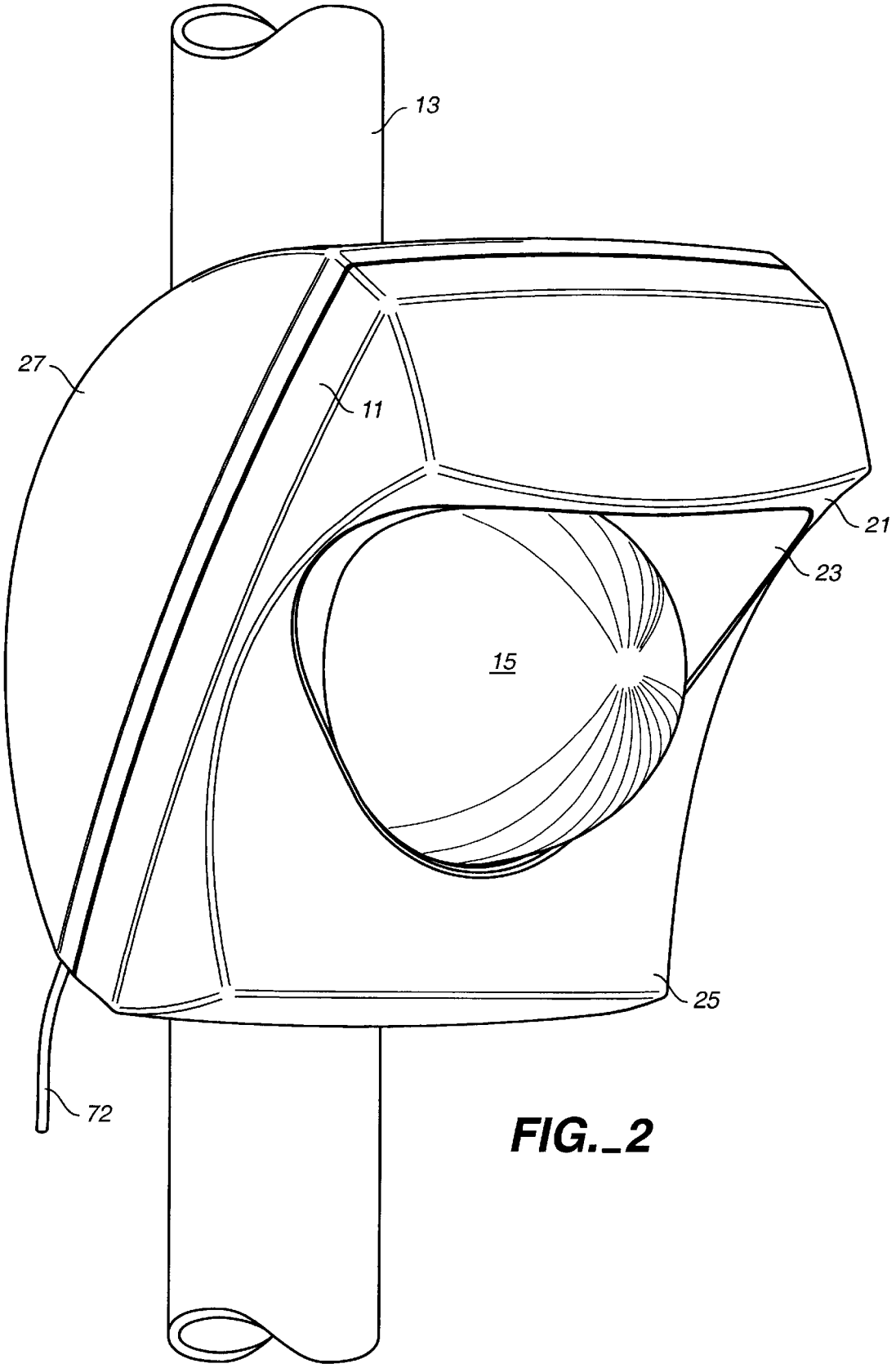
FIG. 2 is an enlarged perspective view of the enclosure shown in FIG. 1.

With reference to FIGS. 1 and 2, an all-weather enclosure 10 is shown having a shroud 11, enclosing electronic components, including a radio transceiver, sending and receiving electromagnetic energy through radome 15. The general cross-sectional shape is elliptical, with the rounded surfaces shedding rain and snow. The enclosure is mounted on mast 13, which is supported, from earth E, or from a structure. The enclosure emits microwave beams 17 in selected directions, towards other similar enclosures in radio line of sight relation, depending upon information contained in messages handled by the radio transceiver within the enclosure.

In FIG. 2, shroud 11 may be seen to have an upper section 21 overhanging the radome 15 and acting as a brim to keep rain or snow, falling vertically, from hitting the radome and sticking to it. Upper section 21 of shroud 11 extends over the profile of the radome in preferred instances, but at least over a portion of the exposed radome. The front face of the shroud has a scooped section 23 which is a curve revolved about an axis. The overhang terminates in a lower outer cover 25 which is joined to a back section 27 which encloses most of the electronic components. The back section is linked via door 65, in FIG. 3 to the upper outer cover 21. The radome 15 may be seen to have a rounded convex, bullet-shaped nose pointing in a fixed direction relative to the shroud.

Figure 3:
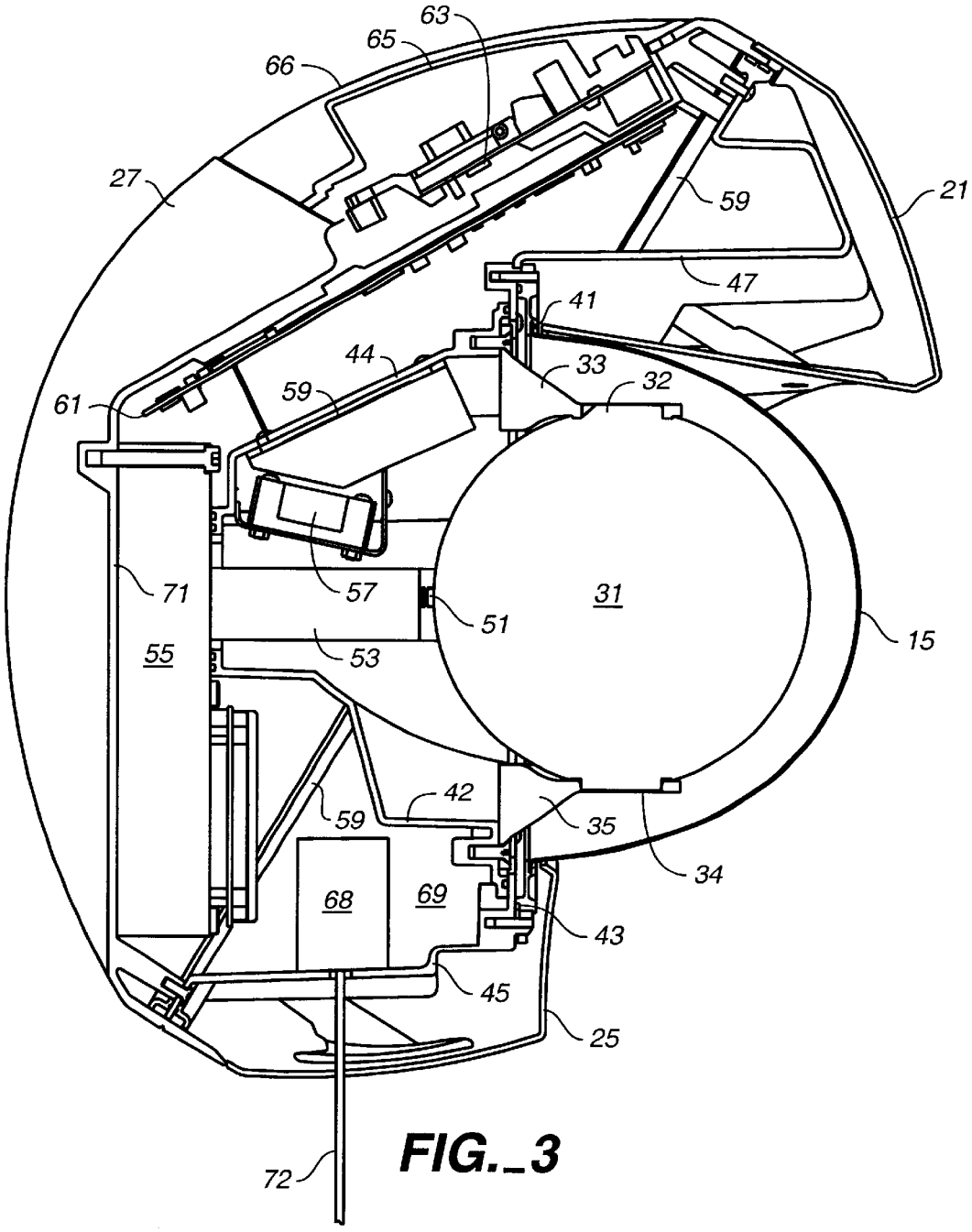
FIG. 3 is a cross-sectional view of the interior of the enclosure shown in FIG. 1, taken along lines 3—3.

With reference to FIG. 3, the shroud is seen to have upper cover 21 overhanging the radome 15. The radome acts as a protective enclosure for microwave refractive lens 31 which focuses microwave energy from a plurality of feed ports 51 associated with a plurality of switches 53 (Described in PCT Application WO 01/28162 Apr. 19, 2001) which are actuated by routing instructions within radio messages as explained in the above-mentioned international patent applications. The feed ports are microwave transmission guides disposed in an arc, following the contour of the lens 31 and in close proximity. Each feed port is at a slightly different angle to an axis of the lens 31 for the purpose of directing microwave energy in different selected directions. Each radome has an axis of symmetry.

The switches 53 controlling the feed ports 51 derive energy from a microwave radio transceiver 55 which may be a known type of transceiver mounted to a backing member 71. The backing member forms a portion of a second compartment, within the enclosure, mounting motherboard 61 at an inclined angle and also mounting power supply 63, facing outwardly, toward a door 65 having outwardly facing heat sink fins 66, described below. The backing member 71 is joined to a lower inner cover 45, which, in turn, is joined by means of an O-ring seal 43 to the base 41 of radome 15. Lens 31 has protuberances 32 and 34 projecting outwardly and interlocking with lens support members 33 and 35, respectively.

The curved array of feed ports direct microwave energy into lens 31 at various trajectories selected by control circuitry. Switches 53 select a specific port for feeding or receiving energy to or from lens 31. The energy originates or is directed to a radio transceiver 55 mounted against backing member 71.

A fan 57 moves air warmed by a heater in the vicinity of the lens and directs it toward the radome 15 where the warm air serves to clear any ice or frost, which may cling to the outer surface of the radome. A control circuit, such as an automatic thermostat, regulates temperature by regulating the operation of the heater 59. A motherboard 61 which may include the control circuit is mounted at an angle to the backing member. A diagonal bulkhead 44 adds internal strength to the shroud and serves to anchor the lens support members 33 and 35, as well as the inner cover 45 and 47.

Radome 15 has a base 41, which is secured by means of an O-ring seal 43 to the forward or first compartment of the bulkhead. The forward or first compartment of the shroud includes the lens 31, the feed ports 51, the switches 53, and the wall members 42 and 44. An inner cover 47 and the lower front cover 45 uses the annular seal 43 to provide a closure within the shroud for the second compartment containing electronics equipment. Lens 31 is inside the first compartment, with the radome 15 being part of the shroud. Note that the second compartment wraps around, or envelops, the first compartment, with the shroud enveloping both compartments. The bulkhead 42 and 44 may optionally include RF shielding material to prevent non-focused microwave energy from entering the space behind the bulkhead, i.e. entering the second compartment. In other words, the upper section 21 is on the radome side of the seal 43. A space 69, just above the outer cover 45, is provided for a second radio transceiver 68 which may provide local communication by means of an antenna 72. The second radio transceiver is optional and is used for local communication, for example, in the ISM, MMDS, UNII, etc bands. Door 65 provides access to the input/output board and power supply 63, inside of the shroud. Multiple cables may pass through a seal in the door and compartment, including a power cable, a data cable and a fiber-optic, high-speed data cable.

It should be noted that the upper outer cover 21 and the lower outer cover 25 may be integrally formed of a single piece of material. Similarly, the bottom inner cover 45 and the upper inner cover 47 can be integrally formed of a single piece of material.

Figure 4:
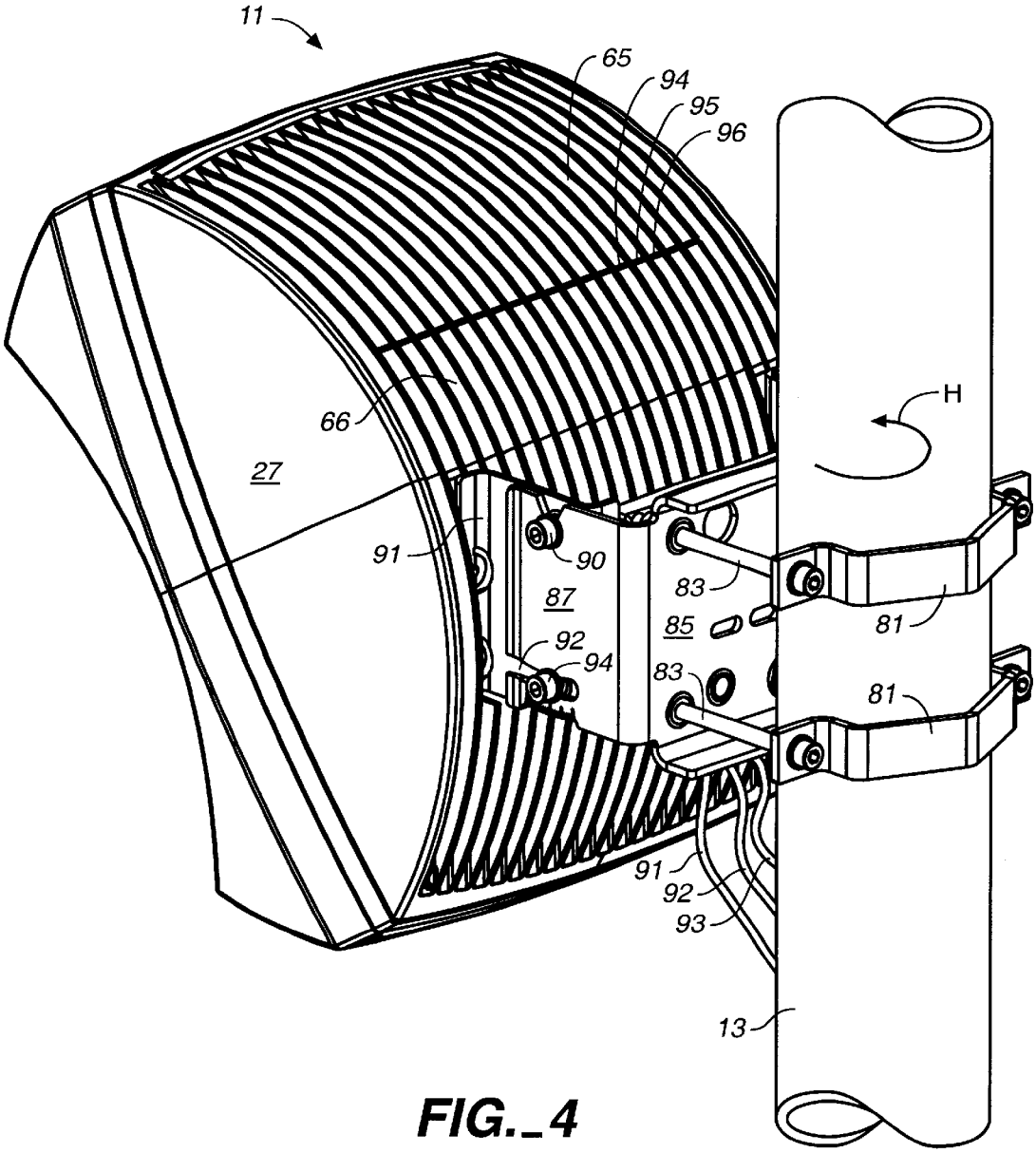
FIG. 4 is a rear perspective, view of the enclosure of FIG. 1 illustrating mast-mounting details.

With reference to FIG. 4, the back section 27 of shroud 11 has fins 66 which are parallel, spaced apart members formed integrally with the back section 27. The spacing between fins is uniform and into the space between two adjacent fins, a pair of stanchions 91 are placed to firmly attach to the standoff bracket 87. The standoff bracket has a distal end mounting a compression back member 85, which may be curved to receive mast 13. Compression bracket caps 81 secure the mast 13 to the bracket back member 85 by means of machine screws 83, which pass through both the bracket cap 81, and the bracket back member 85. By rotating the compression back member horizontally relative to the mast, angular adjustments may be made in the horizontal plane, indicated by the arrow H in FIG. 4. Stanchions 91 pivot about screw 90, with a slot 92 in plate 87 allowing screw 94 to lock the plate after allowing vertical angular adjustment of the shroud relative to the mast. In other words, the shroud is adjustable in its vertical angle and horizontal angle relative to the mast, which is generally fixed. Once adjusted, the radome is in a fixed position. Power cable 91, signal wire cable 92 and fiber optic cable 93 communicate with the housing from exterior sources. The cables follow grooves between fins 66 and enter the housing through entry holes 94, 95 and 96, respectively, at the base of door 66.

Figure 5:
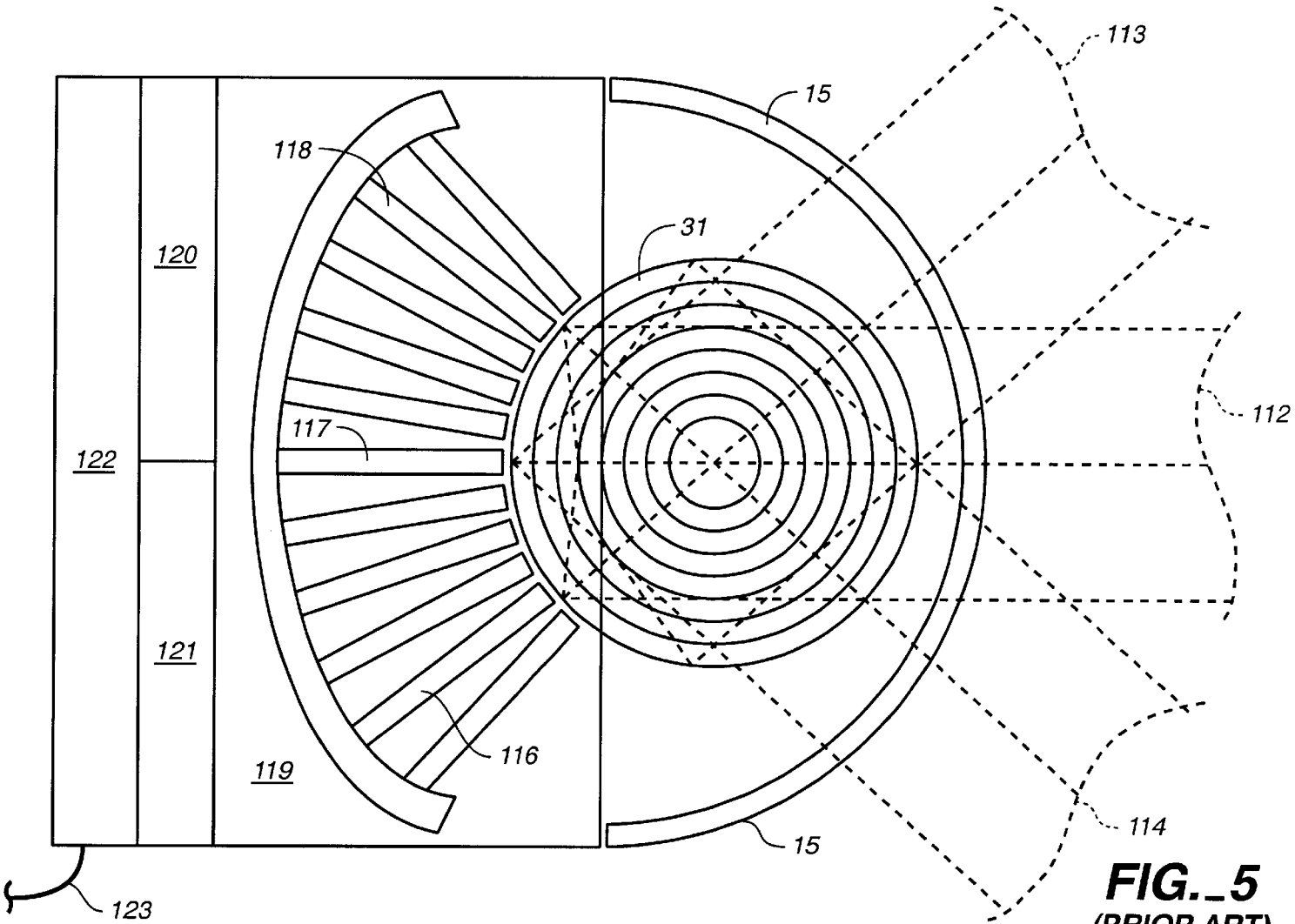
FIG. 5 (PRIOR ART)
FIG. 5 is an electrical operational view of refractive lens element used inside of the enclosure of FIG. 1 in accordance with published PCT Application WO 01/28162 Apr. 19, 2001.

In FIG. 5, described more fully in PCT patent application WO 01/28162, published Apr. 19, 2001, by the applicant who is the assignee of the present invention, the microwave lens 31 may be seen in an operational, sectional view near radome 15. The concentric circles in the lens 31 represent material of changing refractive index. Such a lens is known as a graded index lens, such as a Lunenburg, or Morgan lens, and serves to form a microwave beam, or to receive microwaves from a selected direction. A number of feed ports 116, 117, and 118, plus others, are located about the rearward circumference of lens 31 to provide microwave energy to form beams in selected directions. The feed ports determine the angular orientation of beams emitted from the front of radome 15. Similarly, the feed ports accept energy, which is focused by the lens 31 in preferential directions after passing through the radome 15. A number of switches in the switch box 119 route the directionality information to the appropriate feed element. The switch box 119 electrically communicates with transmitter section 120 and receiver section 121 of a transceiver associated with the local network node. Control circuitry 122 receives and transmits information locally along cable 123. This information contains both the control channel and data channel, which must be read by the control circuitry for implementation of the scheduling algorithm, which is part of the MAC protocol.

Microwave beam 112 may be seen to be associated with feed port 117, while beams 113 and 114 may be seen to be associated with feed ports 116 and 118, respectively. The beams may be seen to be focused by the lens 31, in a refractive manner, to the associated feed element. Using lens 31, the feed ports impart a selected directionality to the beams. The beams are seen to pass through the radome 15, which provides a protective environment for the lens, the feed element and the associated electronics, preventing accumulation of ice on the lens. The feed ports typically have an internal rectangular cross-section, as typical in microwave transmission apparatus. The feed ports are arranged so that the ports are aligned about the periphery of lens, thereby allowing a good number of ports to be closely spaced about the periphery of the lens.

Figure 6:
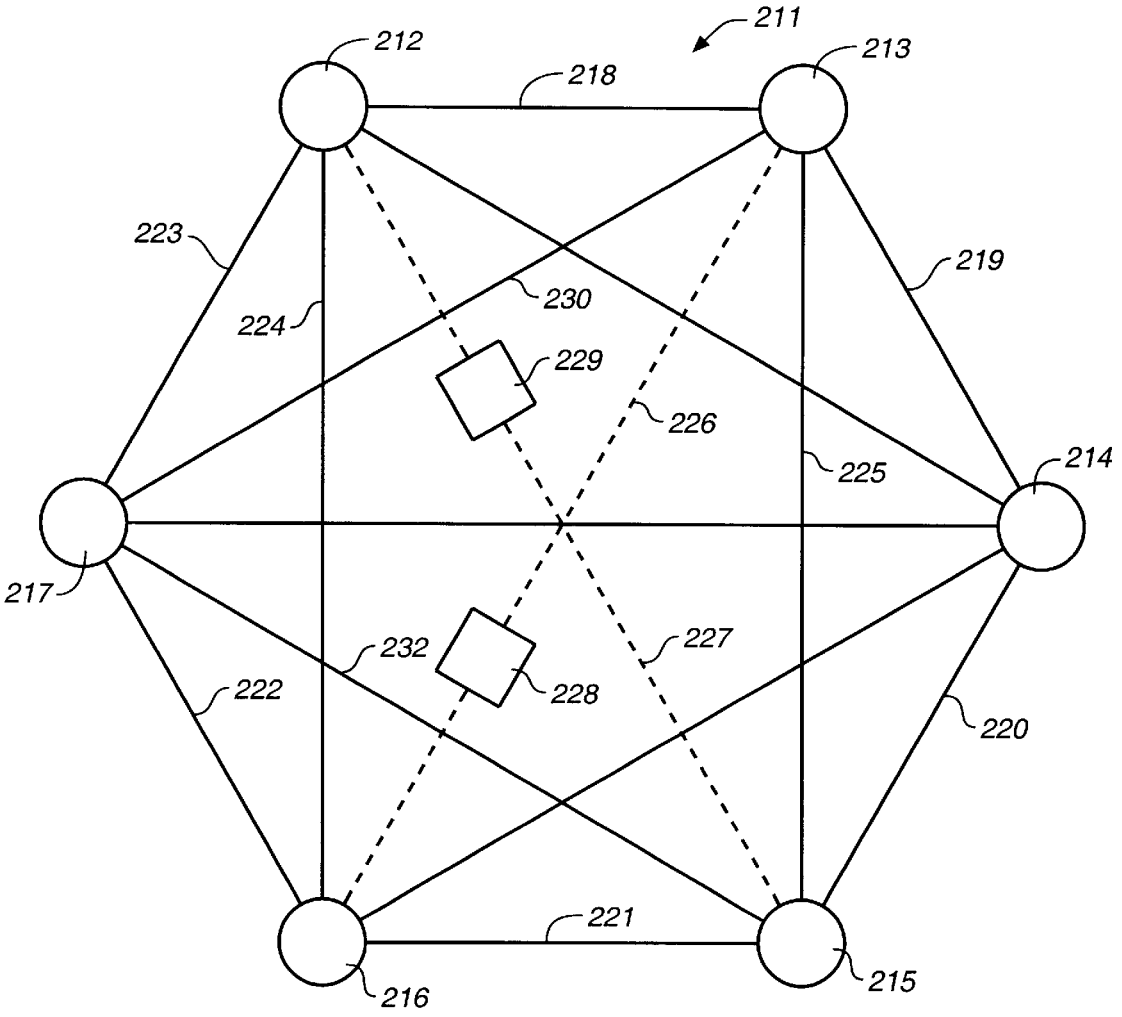
FIG. 6 is a plan view of a radio network employing a plurality of enclosures of the kind shown in FIG. 1.

FIG. 6 illustrates the operation of a network 211 employing the present invention. A number of network nodes having enclosures 212–217 is illustrated with each enclosure, either simultaneously or sequentially, communicating with a number of neighbors in radio line of sight relation using paths 218–225. Paths 226 and 227 which are blocked from being in true line of sight communication by obstacles 228 and 229, so that nodes 213 and 216 cannot communicate by path 226, but may communicate via relay of information to other nodes, such as nodes 214 and 215 using paths 219, 220 and 221, or alternatively via node 217 using paths 230 and 222. Similarly nodes 212 and 215 cannot communicate on path 227 because of obstacle 229, but can communicate using neighbor nodes 214 or 217, for example, which are in radio line of sight communication. In this case, nodes 212 and 215 could communicate by paths 223 and 232, or via paths 218 and 225, as examples. Other paths exist. Communication may be selected via the best available path. It may be seen that route diversity exists in the network with clockwise or counterclockwise paths available. Particular paths are selected by control information in a control channel which update the path availability at the node routing data base. For example, enclosure 213 can communicate directly with enclosure 215. However, if the direct path is impaired, enclosure 213 can route the communication to node 214 and from there to node 215. Other paths are available.

What is claimed is:

1. A plurality of all weather enclosures for mast mountable microwave radio transceivers in a network, each enclosure comprising, an environmentally protective, mast mountable shroud having a radome projecting from the shroud in line of sight relation to other radomes, a microwave radio transceiver disposed within the shroud, a microwave refractive lens disposed adjacent to the radome, inside of the shroud, and an array of feed ports disposed between the transceiver and the lens in a position communicating microwave energy between the transceiver and the radome through the lens in multiple selected directions, and a plurality of switches selectively connecting feed ports to the transceiver whereby microwave radio energy may be transmitted and received in multiple selected directions.

2. The apparatus of claim 1 wherein the shroud has a brim extending over the radome.

3. The apparatus of claim 1 wherein the shroud has heatsink surfaces within the shroud and cooling fins projecting from an exterior surface of the shroud.

4. The apparatus of claim 1 wherein the shroud has a door in an exterior surface of the shroud giving access to the power supply adjacent to the exterior shroud surface.

5. The apparatus of claim 1 wherein the multiple selected directions span an angle greater than 90 degrees.

6. A plurality of all weather enclosures for outdoor microwave radio transceivers in a network, each enclosure comprising, an environmentally protective, outdoors shroud having a radome, a microwave radio transceiver disposed within the shroud, a ball-shaped microwave refractive lens disposed adjacent to the radome, inside of the shroud, a curved array of feed ports disposed between the transceiver and the lens in a position near a surface of the lens communicating microwave energy between the transceiver and the radome through the lens in multiple selected directions, the curvature of the array following curvature of the lens surface, and a plurality of switches selectively connecting feed ports to the transceiver whereby microwave radio energy may be transmitted and received in multiple selected directions.

7. The apparatus of claim 6 wherein the shroud has a bracket mounting the shroud to a mast, the bracket having angular adjustments for horizontal and vertical angles.

8. An all-weather housing for mast mountable microwave radio transceivers comprising, an exterior shroud protectively shielding an exposed radome in a sealed relationship therewith, the radome having a rounded convex portion pointing in a fixed direction relative to the shroud, the shroud having an extended portion over at least some of the exposed radome and a rearward portion having a mounting bracket attached thereto capable of attachment to a mast, a curved microwave radiation lens located proximate to the radome and within the shroud near an array of feed ports and associated switches capable of directing microwave energy toward and from the lens at different selected angles, and a microwave radio transceiver connected to the switches in a manner selectively directing and receiving microwave energy to and from the feed ports, whereby selectively directed beams containing the microwave energy emerge from and enter the lens in selected directions over an angular range.

9. The apparatus of claim 8 wherein said shroud has a rounded cross-sectional shape.

10. The apparatus of claim 8 wherein the microwave lens comprises a graded index lens.

11. The apparatus of claim 8 wherein the microwave lens comprises a Lunenburg or Morgan lens.

12. The apparatus of claim 8 wherein the shroud encloses an electrical fan circulating air within the shroud.

13. The apparatus of claim 12 further having an electrical heater in proximity to the fan, and a control circuit to operate the heater and the fan to circulate warm air within the radome with sufficient capacity to avoid accumulation of water or ice on the exterior surface of the radome.

14. The apparatus of claim 8 wherein said shroud has a first compartment housing said lens, feed ports and switches and a second compartment housing said transceiver.

15. The apparatus of claim 14 wherein the second compartment envelops the first compartment.

16. The apparatus of claim 14 wherein said compartments are at least partially separated by radio frequency shielding near the base of the radome.

17. The apparatus of claim 8 wherein said shroud has a rearward portion, opposite the radome, having radiative heat sink fins.

18. The apparatus of claim 8 wherein the microwave lens has a ball shape.

19. The apparatus of claim 18 wherein said microwave lens has spaced apart protuberances interlocking with spaced apart sockets of a support frame.

20. The apparatus of claim 19 wherein the spaced apart protuberances are positioned at opposed parts of the ball lens.

21. The apparatus of claim 17 wherein the rearward portion of the shroud has a door mounting a power supply facing toward the radome.

22. The apparatus of claim 21 wherein said door has radiative heat sink fins facing opposite the radome.

23. The apparatus of claim 22 wherein the fins are integral with the shroud.

24. The apparatus of claim 8 wherein a portion of the shroud extends forwardly over the radome forming a protective brim for the radome.

25. The apparatus of claim 8 wherein the array of feed ports direct beams to emerge from the microwave lens spanning an angular range up to 120 degrees.

26. The apparatus of claim 8 wherein the shroud houses a second radio transceiver having a frequency different from said microwave frequency transceiver.

27. The apparatus of claim 26 wherein the shroud has an antenna associated with the second radio transceiver mounted at the bottom of the shroud.

28. The apparatus of claim 17 wherein said mounting bracket is attached to the heat sink part of the shroud.

29. The apparatus of claim 28 wherein the mounting bracket is angularly adjustable across horizontal angles.

30. The apparatus of claim 28 wherein the mounting bracket is angularly adjustable across vertical angles.

31. The apparatus of claim 8 wherein the shroud has a first compartment housing the microwave lens, switches and feed ports array, a second compartment housing electronic components, with the shroud enveloping the first and second compartments.

32. The apparatus of claim 31 wherein the second compartment envelopes the first compartment.

33. The apparatus of claim 28 further comprising a mast supporting said shroud.

34. The Door of claim 21 further comprises a sealed entry for power, data and fiber optic cables to the space below the door.

35. The apparatus of claim 8 wherein the apparatus is one of a plurality of similar microwave radio enclosures in a mesh topology network, each enclosure in radio line-of-sight microwave radio communication with at least another enclosure in said network.

* * * * *